United States Patent [19]

Stobb

[11] Patent Number: 4,793,227

[45] Date of Patent: Dec. 27, 1988

[54] APPARATUS AND METHOD FOR TRIMMING SIGNATURES

[75] Inventor: Walter J. Stobb, Pittstown, N.J.

[73] Assignee: Stobb Inc., Clinton, N.J.

[21] Appl. No.: 61,726

[22] Filed: Jun. 15, 1987

[51] Int. Cl.[4] ..... B26D 1/02; B26D 1/20

[52] U.S. Cl. ..... 83/21; 83/29; 83/34; 83/151; 83/155; 83/154; 83/155.1; 83/508; 83/509; 83/425.4; 83/925 A

[58] Field of Search ..... 83/508, 509, 425.3, 83/425.4, 29, 151, 154, 430, 925 A, 21, 34; 270/21.1, 54

[56] References Cited

U.S. PATENT DOCUMENTS

| | | | |
|---|---|---|---|
| 773,563 | 11/1904 | Ginn | 83/508 |
| 909,853 | 1/1909 | Denison | 83/508 |
| 974,198 | 11/1910 | Smith | 83/154 |
| 2,623,586 | 12/1952 | Volpi | 83/509 |
| 2,756,819 | 7/1956 | Judelson | 83/509 |
| 3,884,102 | 5/1975 | Faltin | 83/925 A |
| 4,046,043 | 9/1977 | Kistner et al. | 83/925 A |
| 4,274,319 | 6/1981 | Frye et al. | 83/430 |
| 4,480,518 | 11/1984 | Futterer | 83/925 A |
| 4,496,140 | 1/1985 | Stobb | 270/54 |
| 4,511,131 | 4/1985 | Raybuck | 270/54 |
| 4,566,360 | 1/1986 | Lehmann | 83/925 A |

*Primary Examiner*—Frank T. Yost
*Assistant Examiner*—Scott A. Smith
*Attorney, Agent, or Firm*—Arthur J. Hansmann

[57] ABSTRACT

Apparatus and method for trimming signatures moving in a continuous stream and in an arcuate path as controlled by a conveyor. A trimming knife is stationarily disposed adjacent the arcuate path for engaging the marginal edges of the signatures and trimming those edges. Input and output conveyors are in signature-flow communication with the conveyor of the arcuate path, and either input or output conveyor can be reversed for the input and output function, and also the conveyor having the arcuate path can accordingly be reversed so that the signatures can move in either continuous arcuate path of movement for the trimming process.

13 Claims, 2 Drawing Sheets

APPARATUS AND METHOD FOR TRIMMING SIGNATURES

This invention relates to apparatus and method for trimming signatures so that the marginal edges of the signatures can be cut off the remainder of the signature.

BACKGROUND OF THE INVENTION

The graphic arts industry is concerned with trimming the edges of signatures which are used to form magazines, books, and the like. The trimming provides for the neat and accurate alignment of the edges of the pages in the signatures, and this commonly requires that the signatures be cut or trimmed to provide the neat and aligned edges.

U.S. Pat. Nos. 974,198 and 4,511,131 show prior trimming devices where signatures or the like are moved over a cylinder or roller while a disk type of cutter or trimmer is applied to the signatures on the cylinder or roller, all for removing the marginal edges of the signatures in the trimming process. That type of apparatus requires that the cutter or trimmer itself be a movable blade, and, in those instances, it requires that the blade be rotatably mounted in proximity to the roller or cylinder for rolling therewith during the trimming process. U.S. Pat. No. 4,496,140 shows a signature trimmer wherein the signatures are individually deposited into a rotation device which moves the signatures passed stationary cutters for trimming the edges of the signature.

In the prior art, such as that mentioned, the trimmer is required to be either a movable disk for cooperative rotation with a base cylinder or roller, as mentioned above, or it is required to be a fixed blade which can trim signatures when they are separately presented to the blade. The present invention differs from the prior art in that it provides for a method and apparatus of trimming signatures which are disposed in a continuous stream of overlapped signatures moving in an arcuate path and against a stationary knife, all for trimming one edge or the opposite edges from the stream of signatures in the continuous movement of the signatures. As such, the present invention improves upon the prior art in providing for the neat and arcuate trimming of the signatures which are continuously moving in the common type of conveyance of signatures, namely, in an arcuate path and constrained by conveyors formed by belts or the like, and thus only a stationary knife is required adjacent the arcuate path for engagement of the signatures in the trimming process. As such, the present invention simulates a trimming process of the nature of scissors or a conventional cutter in that there is a flat lead-in approach of the signatures to the trimmer itself. That is, the trimmer of this invention provides for a very shallow angle of trimming to present the cutting edge in the nature of a conventional cutter while still moving the signatures in a continuous path past the cutter and not requiring that the cutting edge itself be moved or that the signatures be stopped for the cutting process. In this invention, the approach angle for cutting is in the nature of a crescent shape opening into which the signatures move and thereby encounter the very small angle of cutting, as is most desirable.

Still further, the present invention provides for the trimming of the opposite sides of signatures in a simultaneous trimming process, and also a third side of the signatures can be readily trimmed in the same manner after the signatures are moved from the first trimmer and to a second trimmer or cutting edge arranged in the same manner as the first trimmer is arranged. In all, the signatures continue to move and thus the desired high production is achieved throughout the conveying and trimming process.

BRIEF DESCRIPTION OF THE DRAWINGS

FIG. 5 is an enlarged view of a fragment of FIG. 2, and showing a modification thereof.

DETAILED DESCRIPTION OF THE PREFERRED APPARATUS AND METHOD

Figure 1:
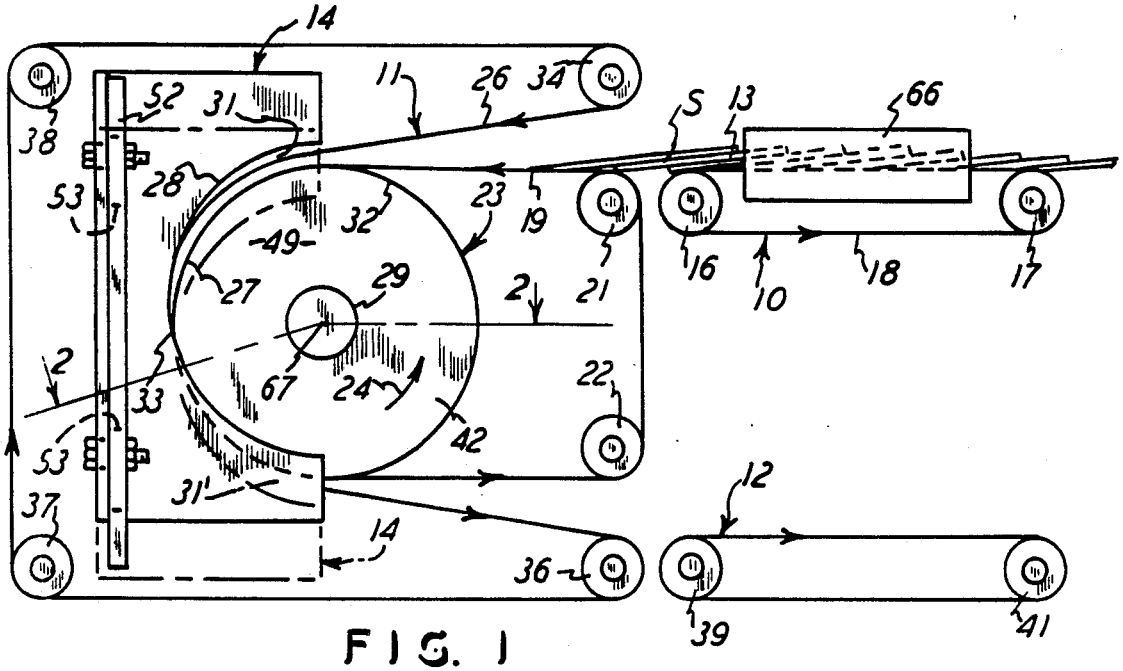
FIG. 1 is a side elevational view of a preferred embodiment of this invention.
Figure 2:
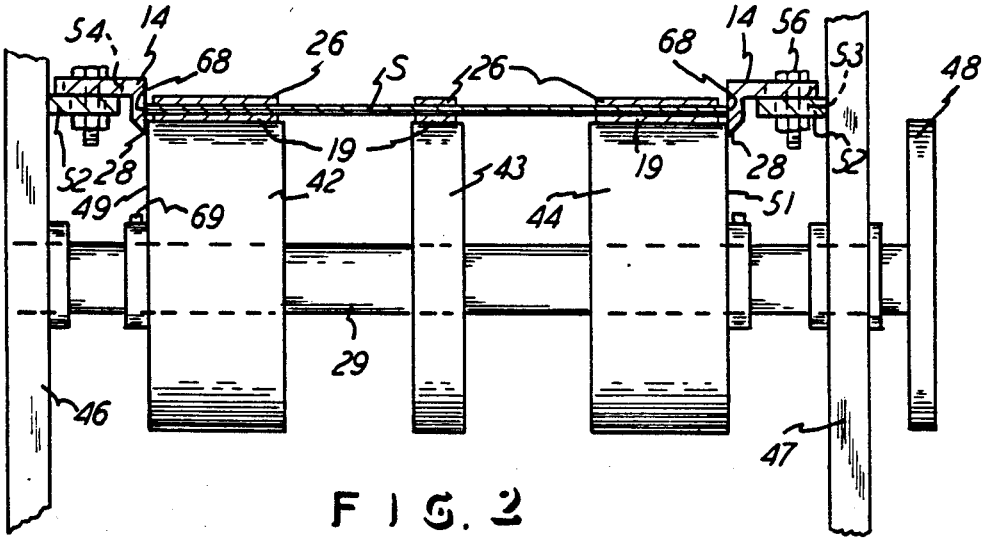
FIG. 2 is a sectional view taken along the line 2—2 of FIG. 1.

FIGS. 1 and 2 generally show the arrangement of conveyors 10, 11, and 12 arranged for movement in the direction of the arrows shown on each of the conveyors for transporting signatures S, firstly on the conveyor 10 and then onto the conveyor 11 and finally onto the conveyor 12. In the process, the signatures S are trimmed at their opposite marginal edges, such as the edge designated 13, by means of a knife 14 disposed adjacent the conveyor 11.

Accordingly, the conveyor 10 is arranged to have two rotatably mounted pulleys 16 and 17 move a conveyor belt 18, or the like, in the direction of the arrow thereon so that the signatures S move leftwardly, as viewed in FIG. 1. The signatures are shown in an overlapped relation and they therefore move in a continous stream along the path defined by the several conveyors mentioned. Signatures S are thus passed to a belt 19 included in the conveyor 11, and the belt 19 is trained over the rotatably mounted pulleys 21 and 22 and over a cylinder or roller, generally designated 23 and which is rotatable in the direction of the arrow 24, in the mode shown in FIG. 1. The conveyor 11 also includes a belt or set of belts 26 which move in the direction shown thereon, and thus there are two sets of belts 19 and 26 which respectively engage the bottom and top surfaces of the stream of signatures S to move the signatures around the arcuate path designated 27 and defined generally by the left-hand semi-circle of the cylinder 23, as viewed in FIG. 1. Thus the belts 19 and 26 securely hold the stream of signatures S therebetween, and they move the signatures against an arcuate cutting edge 28 on the knife 14. In that system, the marginal edges of the signatures S are actually engaged by the cutting edge 28 and are thus removed from the signatures S while the signatures S continue in their path of movement without interruption or slowdown or stopping.

Therefore, it will be seen that the cylinder 23 which is rotatably mounted with a center shaft 29 presents a crescent-shaped opening 31 between the cylinder circumference 32 and the cutting edge 28 which is also shown to be semi-circular or arcuate. In the position established in FIG. 1, the knife 14 is stationary so that the crescent opening 31 remains during the course of the conveyance of the sheets or signatures S, as mentioned, that is, while they are conveyed by the conveyor 11 and against the cutting edge 28 which is also tangential with the circumference 32 of the cylinder 23, such as at the point designated 33. In that arrangement, the signature edges are accurately and easily and neatly sheared from the remainder of the signatures S, as desired.

It will of course be seen and understood that the conveyor belts 26 are movably mounted on the pulleys 34, 36, 37, and 38, as well as extending around the left half portion of the circumference 32, as viewed in FIG. 1. Also, the trimmed signatures S pass between the pulleys 22 and 36 and onto the output conveyor 12 which is movably mounted on the pulleys 39 and 41.

FIG. 2 shows that the cylinder or roller 23 is in three segments 42, 43, and 44 which are of the same diameter and all of which are rotatable as mounted on the shaft 29 extending thereacross as shown. Also, FIG. 2 shows the shaft 29 to be suitably mounted in side frame pieces 46 and 47, and a driven cylindrical member 48, such as a timing pulley, sprocket, or the like, is also mounted on the shaft 29 for inducing the rotation of the cylinder 23. Still further, the cylinder segments 42 and 44 can be moved along the shaft 29, that is along the longitudinal axis of the cylinder 23, for adjustment relative to the conveyor belts and the knife means 14.

FIG. 2 further shows the conveyor belts which clamp the shingled or imbricated signatures S therebetween, and thus the signatures S are presented to the cutting edge means 28 upon movement of the conveyor 11. It will therefore be further seen and understood that there are two knives 14 mounted on opposite ends of the cylinder or roller 23 and with the respective cutting edges 28 faced toward the cylinder 23 and in fact in shearing contact with the cylinder end faces 49 and 51. Each knife 14 is of a plate construction, and can be angled as seen in FIG. 2 to be adjustably mounted on a standard 52 by means of a vertical slot 53 in each standard 52 and a horizontal slot 54 in each blade 14, for instance. Bolts 56 extend through the slots and stationarily position the respective knives 14 relative to the cylinder 23, as shown. Therefore, the knife 14 can be adjusted to the left and right, as viewed in FIG. 2, that is, toward and away from the cylinder ends 49 and 51, respectively, by means of the horizontal slots 54 in each knife 14. Further, the knives 14 can be adjusted up-and-down, as viewed in FIG. 1, and thus be positioned between the solid-line position shown and the dot-dash position shown for the knife 14 in FIG. 1. When the knife 14 is positioned in the solid-line position shown, then the conveyors 10, 11, and 12 will move in the direction of the arrows shown thereon and the signatures S will be trimmed when they enter the crescent opening 31, as mentioned. Alternatively, when it is desired or required that the conveyors 10 and 12 be interchanged so that the conveyor 12 becomes the input conveyor and the conveyor 10 becomes the output conveyor, then those two conveyors operate in the direction opposite to the arrows shown thereon so that signatures S are introduced in the overlapping stream at the lower end of the conveyor 11 which is then also operating in the opposite direction. In that arrangement, the knives 14 have been lowered to the dot-dash position so that a crescent shape 31' is produced at the lower end of the cylinder 23, and the signatures thus enter that crescent shape 31' and are trimmed on their opposite edges as they move upwardly and around to the output conveyor 10.

Figure 3:
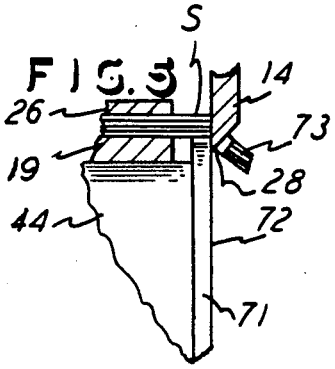
FIG. 3 is a side elevational view, similar to FIG. 1, and showing the drive for the conveyors.
Figure 3:
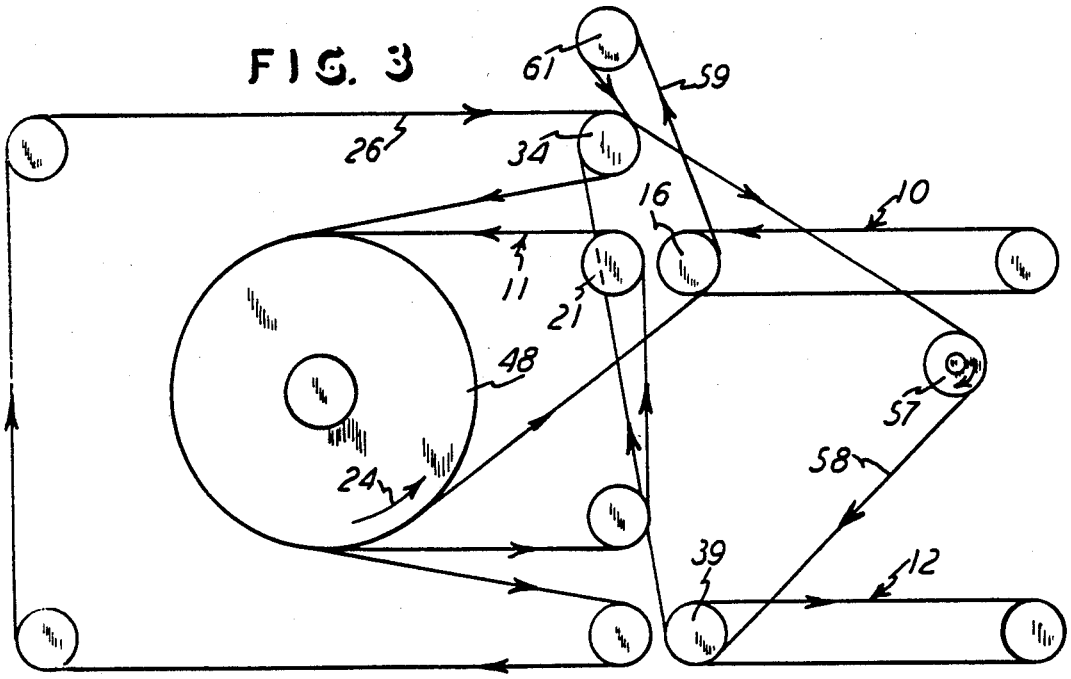
Figure 4:
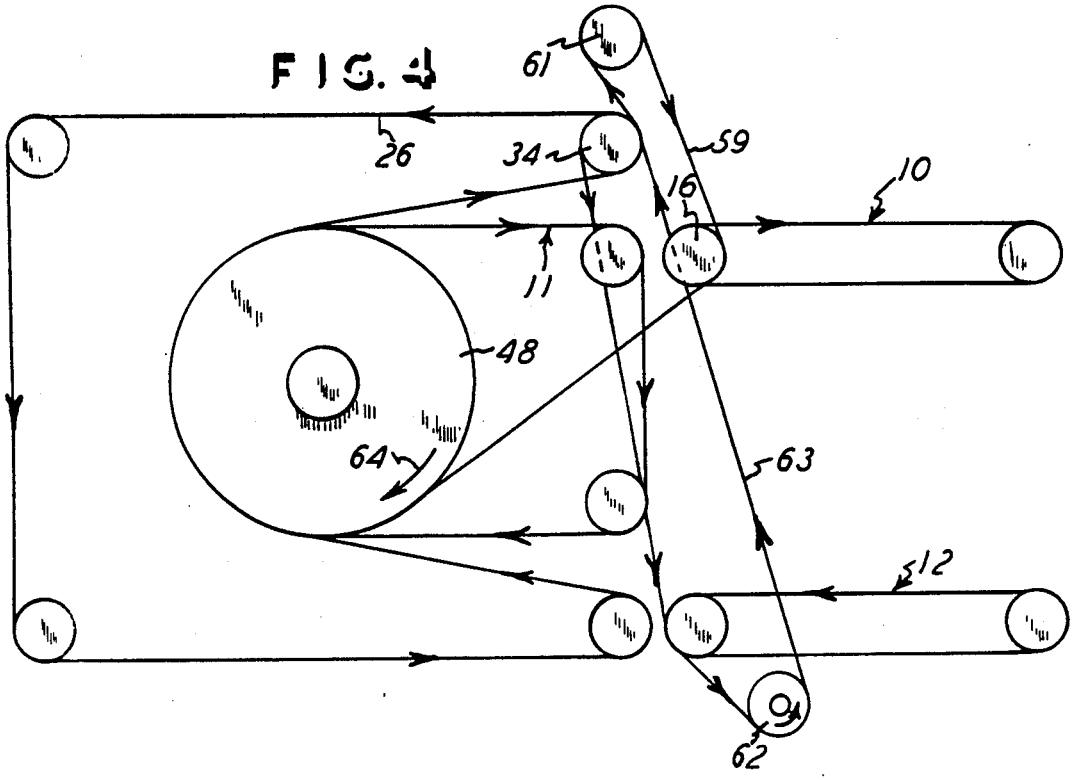
FIG. 4 is a side elevational view, similar to FIG. 1, and showing a drive for the conveyors, but being in the reverse direction from FIG. 3.

FIGS. 3 and 4 show the two opposite drive arrangements for the conveyors, and FIG. 3 shows the drive which is in the direction of that shown in connection with FIG. 1, namely, with the upper conveyor 10 being the input conveyor and the lower conveyor 12 being the output conveyor and with the cylinder 23 rotating in the counter-clockwise direction shown by the arrow 24. As mentioned, in that drive relationship, the knives 14 are in the upper position, and also shown in FIG. 1. To achieve that drive, a drive member 57 is provided in the system and has a timing belt or chain 58 trained thereon and also trained over the pulleys 39 and 34 for movement in the direction of the arrow shown on the chain or belt 58. Further, it will be noticed that the cylinder 23 is engaged by a timing belt or chain 59 which is in driving relation with the driven pulley or sprocket 48, and which is also in driving relation with the pulley 16 and the pulley 34. Further, there is an idler tensioning pulley 61 for the belt or chain 59. In that manner, the driving belt or chain 58 will drive the output conveyor 12 and it will also drive the pulley 34 which is driving the belt 26 and the belt 59 trained on the driven member 34 and on the driven member 48 for the cylinder 23. The drive belt 59 also extends to an idler pulley 61, and to the pulley 16 for driving the conveyor 10. Thus, the three conveyors 10, 11, and 12 are all driven together.

In FIG. 4, the drive arrangement is reverse of that shown in FIGS. 1 and 3, and in that arrangement there is a driving member 62 rotatable in the direction of the arrow shown thereon for driving a chain or timing belt 63 which is in driving relationship with the drive member at 34. Again, the drive connection is such as shown and described in connection with FIG. 3, but of course in the opposite direction. Therefore, the lower conveyor 12 becomes the input conveyor and the upper conveyor 10 becomes the output conveyor, and, the conveyor 11, through the cylinder or roller 23 rotates in the clockwise direction, as shown by the arrow 64. In that mode, the knives 14 have been placed in the lowered or dot-dash position shown in FIG. 1 and as mentioned above.

Also, the signatures S can be subjected to a jogger 66 shown adjacent the input conveyor 10 and being of a conventional design for tapping against the opposite sides of the signatures S and thereby initially align the opposite sides prior to the trimming process described herein. When the conveyor 12 is the input conveyor, such as in the FIG. 4 mode, then the jogger 66 can be located in conjunction with the conveyor 12 for jogging the signatures S. With the alternative arrangement of either conveyor 10 or 12 as input conveyor, the apparatus and method can adapt to existing graphic arts equipment which is moving the signatures S in either the upper or lower elevation described herein. Also, when the knife 14 is shifted up-or-down, a different portion of the arcuate cutting blades 28 is active in the trimming process, and thus a greater length of the blade 28 can be utilized before sharpening or the like might be required. In any event, the blade 14 is stationary when it is in operation, that is, when it is set in either its upper or lower position, and in the upper position of FIG. 1, the center of its semi-circle or arc, which is the cutting edge 28, is offset to a position above the longitudinal axis 67 of the cylinder or roller 23, to thereby present the crescent shaped opening 31 and thus achieve the highly desirable shear action for trimming the signatures S, but not requiring any rotatably mounted or otherwise movable knife or cutting edge.

With the foregoing description, the method and apparatus have both been explained to one of ordinary skill in the art, and it will be understood that the signature opposite edges designated 68 and 68 have been engaged by the cutting edges 28 in the trimming process of the signatures S. Of course in that system, the cylinder or roller 23 serves as the anvil in the trimming or slicing process described, and the cutting edges 28 both overlap the opposite respective edges 49 and 51 of the cylinder 23, as shown in the bottom half of FIG. 1 and in the section view of FIG. 2. Of course for trimming to actually take place, the signatures S would extend in a width beyond the distance between the cylinder faces 49 and 51, and it is that extension or overlap of the signatures S that is deemed to be the marginal edges and which edges are trimmed from the remainder of the signatures S in the continuous movement described. Also, the cylinder segments 42 and 44 are adjustable by means of set screws 69 so that the amount of trim, as well as position with respect to the knives 14, can be adjusted as desired. Further, the entire mechanism or apparatus, as shown for instance in FIG. 1, can be incorporated in one assembly between side frame members 46 and 47, and thus accommodate the delivery onto either conveyor 10 or 12, depending upon the feed-in equipment available, and the drive mechanisms of FIGS. 3 and 4 can also be included in that assembly, as well as the inclusion of the joggers 66, all as described.

FIG. 5 shows a circumferentially extending ridge 71 affixed to the end of roller 44 to radially extend to the thickness of the belt 19 and thereby provide a surface 72 as an anvil for the cutting edge 28 if and when the belt 19 does not align its outer edge with the roller end 51. FIG. 5 also shows the marginal edge 73 of the signatures S trimmed away from the body or remainder of the signatures, after engaging the cutting edge 28.

The signatures S are shingled in the relationship shown in FIG. 1 to have the leading edges which enter the opening 31 underneath the stream, rather on top, that is, to the stream side away from the edge 28. In that manner, the stream is firm against the cutting edge and will not slip from the aligned position of signatures neatly arranged in the stream when the signatures press against the knife edge 28. Also, the upper and lower entries described serve to orient the shingling of the stream, regarding the leading edge relative to the cutting edge.

What is claimed is:

1. A signature trimmer comprising two conveyor belts for transporting along a path a plurality of signatures disposed horizontally between said conveyors, said conveyor belts including an arcuate portion for transporting said signatures along said arcuate portion, a non-moving knife disposed and having an arcuate cutting edge adjacent to and facing said arcuate portion to form a crescent-shaped opening therewith, said arcuate cutting edge extending across said path to be in engagement with said signatures being transported along said arcuate portion, for trimming said signatures.

2. The signature trimmer as claimed in claim 1, wherein said arcuate cutting edge extends entirely across said arcuate portions of said conveyor belts in a view thereof along the longitudinal axis of said arcuate portions.

3. The signature trimmer as claimed in claim 2, wherein said arcuate portion and said cutting edge each present an arc, adjustable mountings for said non-moving knife for adjusting said non-moving knife to have its said arc offset to either side of the axis of said arc of said arcuate portion, and two additional conveyors in signature-flow communication with the first-mentioned said two conveyors and being operable in either direction for conveying signatures either toward or away from the first-mentioned said two conveyors.

4. A signature trimmer comprising a conveyor for signatures arranged to carry a stream of signatures, said conveyor including a rotatably mounted cylinder for conveying said signatures in an arcuate path extending along a portion of said cylinder, and a non-moving knife having a cutting edge disposed to face toward, and be adjacent to, said portion of said cylinder and disposed in signature-trimming relationship with said portion of said cylinder for trimming the edges from said signatures being conveyed past said non-moving knife, said cutting edge being of a shape extending along an arc faced toward said portion of said cylinder and with the center of the curvature of said arc being offset from the longitudinal axis of said cylinder.

5. The signature trimmer as claimed in claim 4, wherein said cutting edge is disposed to overlap the end of said cylinder for the trimming of said signatures.

6. The signature trimmer as claimed in claim 4, wherein said conveyor includes conveyor belts trained over said cylinder and conveying said signatures in said arcuate path extending along said portion of said cylinder and with an edge of said signatures extending beyond the end of said cylinder, and said cutting edge being disposed to overlap said end of said cylinder and thereby be arranged to engage said edges of said signatures and trim said signatures which move into said cutting edge.

7. The signature trimmer as claimed in claim 6, wherein said cutting edge is of a shape extending along an arc faced toward said portion of said cylinder and with the center of the curvature of said arc being offset from the longitudinal axis of said cylinder.

8. The signature trimmer as claimed in claim 7, including a radially extending ridge circumferentially disposed on said cylinder to the height of said signatures to said cutting edge.

9. The signature trimmer as claimed in claim 6, including an additional non-moving knife disposed spaced from the first-mentioned said non-moving knife and having a cutting edge disposed to face toward, and be adjacent to, said portion of said cylinder and disposed in signature-trimming relationship with said portion of said cylinder for trimming the edges from said signatures being conveyed past said additional non-moving knife, said cutting edges respectively disposed at opposite ends of said cylinder for trimming the respective marginal edges of said signatures moving into said cutting edges.

10. The signature trimmer as claimed in claim 7, wherein said non-moving knife is adjustably mounted to be selectively positionable with its said center of curvature offset to either side of said longitudinal axis for trimming said signatures in respect to either direction of rotation of said cylinder, drive means for rotating said cylinder in either direction of rotation, and two additional conveyors in signature-flow communication with said cylinder and being operable in either direction for conveying signatures either toward or away from said cylinder.

11. The signature trimmer as claimed in claim 4, wherein said cylinder includes a plurality of cylindrical segments, adjustable mountings for said segments and arranged to adjustably position said segments along the longitudinal axis of said cylinder, and adjustable mountings for said non-moving knife and arranged for positioning said non-moving knife in accordance with the position of the end of said cylinder.

12. A method for trimming edges from signatures, including the steps of disposing the signatures in a line and conveying them in a semi-circular path with the marginal edges of the signatures to be cut off extending along said semi-circular path, conveying the signatures against and beyond a non-moving cutting edge faced toward the marginal edge for removal of the marginal edges in the continuous conveyance of the signatures, and selectively shifting said cutting edge to a set position offset in the circular direction relative to either side of said semi-circular path, and selectively conveying signatures in either circular direction along said semi-circular path.

13. A method for trimming edges from signatures, including the steps of disposing the signatures in a continuous stream of a shingled relationship and conveying them in a semi-circular path with the marginal edges of the signatures to be cut off extending along said semi-circular path, conveying the signatures against and beyond a non-moving cutting edge faced toward the marginal edges for removal of the marginal edges in the continuous conveyance of the signatures, and orientating the shingled relationship to have the leading edge of each of said signatures being on the side of said stream away from said cutting edge.

* * * * *